United States Patent [19]

Van de Sande et al.

[11] Patent Number: 4,605,613

[45] Date of Patent: Aug. 12, 1986

[54] BALLASTED DYE COMPOUNDS WITH LINKAGES CONTAINING THREE AROMATIC NUCLEI FOR USE IN A DYE DIFFUSION TRANSFER PROCESS AND ELEMENT

[75] Inventors: Christian C. Van de Sande, Belsele; Armand M. Van den Bergh, Berchem; Wilhelmus Janssens, Aarschot, all of Belgium; Hans Vetter, Cologne, Fed. Rep. of Germany

[73] Assignee: Agfa-Gevaert, N.V., Mortsel, Belgium

[21] Appl. No.: 759,345

[22] Filed: Jul. 26, 1985

[30] Foreign Application Priority Data

Aug. 11, 1984 [EP] European Pat. Off. ..... 84201164.5

[51] Int. Cl.[4] ..... G03C 1/40; G03C 5/54

[52] U.S. Cl. ..... 430/562; 430/222; 430/223; 430/561

[58] Field of Search ..... 430/223, 562, 222, 561

[56] References Cited

U.S. PATENT DOCUMENTS

| | | | |
|---|---|---|---|
| 4,368,251 | 1/1983 | Ono et al. | 430/223 |
| 4,468,452 | 8/1984 | Nakamura et al. | 430/223 |
| 4,520,095 | 5/1985 | Kobayashi et al. | 430/223 |

*Primary Examiner*—Richard L. Schilling
*Attorney, Agent, or Firm*—A. W. Breiner

[57] ABSTRACT

Photographic silver halide emulsion material for use in a dye diffusion transfer process incorporating a non-diffusing compound capable of releasing a diffusible mono-azo dye or dye precursor thereof from a carrier moiety, said compound corresponding to the following general formula (I):

(I) CAR—L—G—D wherein:

CAR represents a ballasted carrier moiety,

L represents a chemical group cleavable or releasable from the carrier moiety as a function of a redox-reaction or argentolytic reaction taking place in the development of a silver halide emulsion layer under alkaline conditions, G represents a bivalent organic group incorporating at least three aromatic nuclei, selected from the group consisting of homocyclic or heterocyclic aromatic nuclei, with the provisions that L is linked to one end nucleus and that D is linked to the other end nucleus of said bivalent organic group; said linking being by means of a direct bond or by means of a bivalent mono- or polyatomic group, and D is an azo dye part linked to said other end aromatic nucleus of G.

6 Claims, No Drawings

BALLASTED DYE COMPOUNDS WITH LINKAGES CONTAINING THREE AROMATIC NUCLEI FOR USE IN A DYE DIFFUSION TRANSFER PROCESS AND ELEMENT

The present invention relates to organic compounds for use in a dye diffusion transfer process and photographic elements incorporating them.

Important non-conventional multicolour reproduction systems are based on dye diffusion transfer processing. These systems are of particular value for reasons of simplicity of processing and rapidity of access to the colour image.

Dye diffusion transfer imaging can be carried out in a number of ways but each system is based on the same principle, namely the alteration of the solubility of dyes controlled by the development of the photographic silver image.

In commonly known dye diffusion transfer processes the dye-image-producing compounds are (A) initially mobile in alkaline aqueous media and become immobilized during processing, or (B) they are initially immobile and are mobilized during processing.

A survey of such processes is given by Christian C. Van de Sande in Angew.Chem.Int.Ed.Engl. 22 (1983) 191–209.

Known compounds for use in a dye diffusion transfer process include e.g. triphenylmethane, xanthene, azo, azomethine, anthraquinone, alizarine, merocyanine, quinoline or cyanine dye structures. Of particularly frequent use is a mono-azo-dye group (ref. e.g. U.S. Pat. No. 3,725,062).

Redox-controlled dye-releasing compounds are introduced in commercial systems and are known from various sources.

Oxidizable dye-releasing compounds that after oxidation release a dye moiety by hydrolysis are known, e.g., from DE-A Nos. 2,242,762, 2,406,664, 2,505,246, 2,613,005, 2,645,656 (DE-A stands for German Auslegeschrift) and Research Disclosure publications Nos. 15,157 (November 1976), 16,654 (April 1977) and 17,736 (January 1979).

In these references dye-releasing compounds are described in which the dye moiety is linked most frequently to an oxidizable carrier moiety through a sulphonamido group. The dye released from such compounds contains a sulphamoyl group.

Oxidizable dye-releasing compounds which in oxidized form release a dye moiety by intramolecular displacement reaction are described, e.g., in U.S. Pat. No. 3,443,940. The dye released from these compounds contains a sulphinate group.

It is particularly interesting in dye diffusion transfer to operate with dye-releasing compounds the dye release from which is inversely proportional to the development of a negative-working silver halide emulsion layer and whereby positive dye images can be formed in a receptor material.

Oxidizable dye-releasing compounds that in oxidized form are stable but in reduced state set free a dye moiety by an elimination reaction are described in DE-A Nos. 2,823,159 and 2,854,946. Compounds of that type when used in reduced form in an unexposed silver halide emulsion material are called IHO-compounds wherein IHO is the acronym for "inhibited hydrolysis by oxidation". When used in the oxidized form these compounds are called IHR-compounds, wherein IHR is the acronym for "increased hydrolysis by reduction".

Reducible quinonoid IHR-compounds which after reduction can undergo a dye release with an intermolecular nucleophilic displacement reaction are described in DE-A No. 2,809,716 wherein these compounds are called BEND-compounds, BEND standing for "Ballasted Electron-accepting Nucleophilic Displacement".

Reducible IHR-compounds which after reduction can undergo a dye release with an elimination reaction are described in the published EP-A No. 0,004,399 and in the U.S. Pat. No. 4,371,604.

Other classes of compounds that may release a dye after reduction are described in DE-A Nos. 3,008,588 and 3,014,669.

Particularly useful are redox-controlled dye-releasing compounds according to the general formula:

BAL—REDOX—DYE wherein:

BAL represents a moiety with ballast residue for immobilizing the dye-releasing compound in a hydrophilic colloid layer, REDOX represents a redox-active group, i.e. a group that under the circumstances of alkaline silver halide development is oxidizable or reducible and depending on the oxidized or reduced state yields a dye release by an elimination reaction, nucleophilic displacement reaction, hydrolysis or cleavage reaction, DYE represents a diffusible dye moiety or a precursor thereof.

It is a requirement that the dyes forming the photographic image have a sufficient stability against visible light. Azo dyes belong to the group of dyes that have a favourable stability in that respect but improvements are still desirable.

Stability against light of azo dyes has been improved by forming complex-compounds with metal ions as described e.g. in U.S. Pat. Nos. 4,207,104 and 4,357,412. The metal ions can be present in the image-receiving layer itself or in a layer adjacent thereto, or the image-receiving layer can be contacted with metal ions in a bath after diffusion of the dye has taken place. Metal ions suited for complexing with particular azo dyes are polyvalent metal ions such as copper(II), zinc(II), nickel(II), cobalt(II), platinum(II) or palladium(II). The use of said ions adds to the cost of the imaging system and makes it ecologically less attractive.

It is one of the objects of the present invention to provide new compounds for use in a photographic dye diffusion transfer process, wherein said compounds yield dye images with improved stability against light without need for complexing polyvalent metal ions.

It is more particularly one of the objects of the present invention to provide new compounds that are capable of releasing a diffusible mono-azo dye as a function of a redox-reaction taking place in the development of a silver halide emulsion layer under alkaline conditions, and that have an improved stability against light by the presence in the releasable dye part of a special non-chromophoric organic group.

It is another object of the present invention to provide a photographic silver halide emulsion material incorporating said compounds in ballasted, i.e. non-diffusing state for image-wise release of a diffusible mono-azo dye in a dye-diffusion transfer process.

In accordance with the present invention ballasted non-diffusing compounds are provided that are capable of releasing a diffusible mono-azo dye or dye precursor thereof from a carrier moiety, characterized in that said compound corresponds to the following general formula (I):

$$CAR—L—G—D \quad (I)$$

wherein:

CAR represents a ballasted carrier moiety making said compound non-diffusing in a hydrophilic colloid medium under wet alkaline conditions e.g. a hydroquinone type or quinone type residue examples of which are described hereinafter, L represents a chemical group cleavable or releasable from the carrier moiety as a function of a redox-reaction or argentolytic reaction taking place in the development of a silver halide emulsion layer under alkaline conditions, G represents a bivalent organic group containing at least three aromatic nuclei, preferably three or four aromatic nuclei selected from the group consisting of homocyclic or heterocyclic aromatic nuclei, with the provisions that L is linked to one end nucleus and that D is linked to the other end nucleus of said bivalent organic group; the said linking being by means of a direct chemical bond or by means of a bivalent mono- or polyatomic group, and D is an azo dye part linked to said last, e.g. third, aromatic nucleus of G.

Compounds of the above general formula contain in the group G as bi-valent homocyclic aromatic groups e.g. three phenylene groups including such groups in substituted form.

Examples of bi-valent heterocyclic aromatic groups are pyridinylene, pyrimidinylene, benzimidazolylene and triazolylene.

Particularly light-fast mono-azo dye compounds according to the present invention are within the scope of the following general formula (II):

(II)

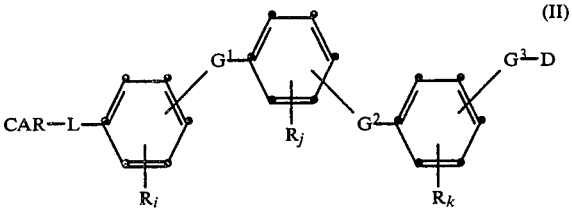

wherein:

CAR, L and D have the same meaning as defined above. Preferably L is —S—, —$SO_2$—, —$NHSO_2$— or —$N^+R^1R^2$—, wherein each of $R^1$ and $R^2$ (same or different) is an alkyl group including a substituted alkyl group or an aryl group including a substituted aryl group, $G^1$, $G^2$ and $G^3$ (same or different) is a chemical bond or a bivalent linking atom or group, e.g. —O—, —S—, —$SO_2$—, —$CH_2$—, —$CH_2CH_2$—, —$NR^3$, —$OCH_2CH_2O$—, —$OCH_2CH_2$—, —$CONR^3$—, $SO_2NR^3$—, —$NR^3CO$—, —$NR^3SO_2$—, wherein $R^3$ is hydrogen, an alkyl group including a substituted alkyl group or an aryl group including a substituted aryl group, and $R_i$, $R_j$ and $R_k$ (same or different) is hydrogen or one or more substituents, e.g. halogen, an alkyl group including a substituted alkyl group, alkoxy, alkylthio, —$NR^{11}R^{12}$, wherein $R^{11}$ and $R^{12}$ (same or different) represent an alkyl group or represent together the necessary atoms to close a nitrogen containing heterocyclic ring, a $R^4CONH$— group or a $R^4SO_2NH$— group, wherein $R^4$ is an alkyl group including a substituted alkyl group or an aryl group including a substituted aryl group.

Examples of carrier moieties including the group L, i.e. (CAR-L-), wherefrom in oxidized form a dye moiety is split off are given hereinafter.

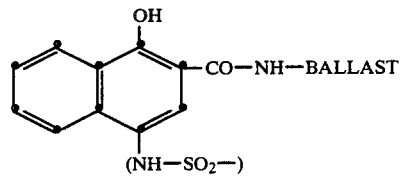

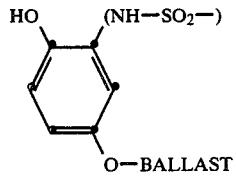

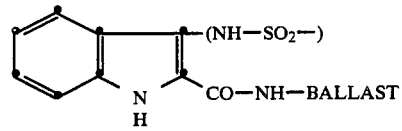

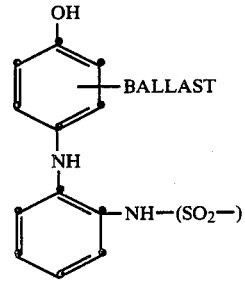

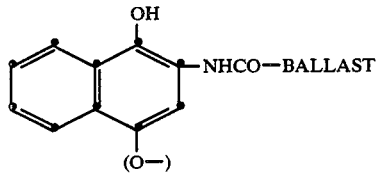

The groups within brackets are released together with the dye moiety (not represented), and remain as diffusion promoting groups with the dye moiety.

In the above mentioned dye-releasing compounds the dye release proceeds directly proportional to the rate of formation of the oxidation products of developing agent used in the development of silver halide. Said compounds are therefore negative working in that they undergo dye release in correspondence with the exposed portions of a negative working silver halide emulsion layer. For the production of positive pictures an image reversal is needed which may be based on the use of positive-working layers containing a direct-positive silver halide emulsion or on the silver salt complex diffusion transfer process by selecting a proper layer assemblage as described, e.g., in published EP-A No. 0,003,376.

Examples of carrier moieties including the group G, i.e. (CAR-L-), wherefrom in reduced state a dye moiety can be set free are the following:

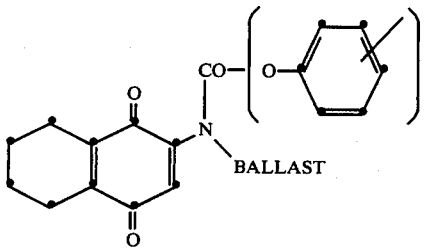

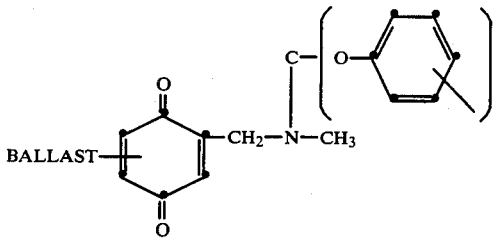

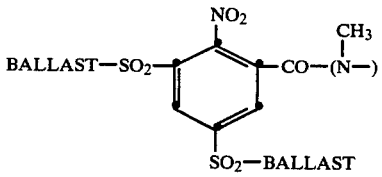

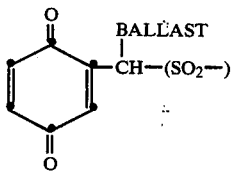

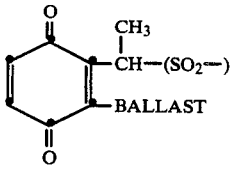

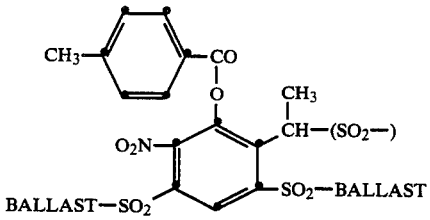

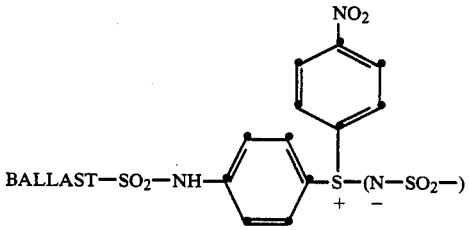

Examples of carriers which can release dyes by argentolysis are described in the already mentioned Angew.Chem.Int.Ed.Engl. 22 (1983) p. 207. Representatives of such carriers are e.g.:

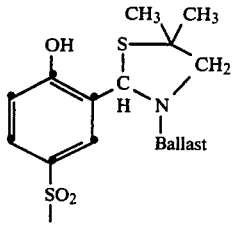

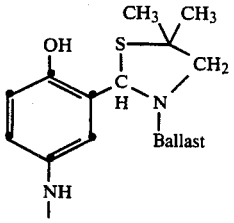

The groups within brackets are functional groups that are split off together with the dye moiety (not shown). These functional groups can be separated from the chromophoric group of the dye by a linking member having no influence on the absorption properties of the dye. The functional group, however, optionally together with said linking member, may be of importance to determine the diffusion-mobility and/or capability of the released dye to be mordanted. Useful linking members are, e.g., alkylene and arylene groups.

Ballast residues (BALLAST) that confer diffusion resistance are residues which allow the compounds according to the invention to be incorporated in a non-diffusing form in the hydrophilic colloids normally used in photographic materials. Organic residues, which generally carry straight- or branched-chain aliphatic groups and also isocyclic or heterocyclic or aromatic groups mostly having from 8 to 20 carbon atoms are preferred for this purpose. These residues are attached to the remainder of the molecule either directly or indirectly, e.g. through one of the following groups: —NH-CO—; —NHSO$_2$—; —NR—, in which R represents hydrogen or alkyl; —O—; —S—; or —SO$_2$—. The residue which confers diffusion resistance may in addition carry groups which confer solubility in water, e.g. sulpho groups or carboxyl groups, and these may also be present in anionic form. Since the diffusion properties depend on the molecular size of the compound as a whole, it is sufficient in some cases, e.g., if the entire molecule is large enough, to use one or more shorter-chain groups as groups conferring resistance to diffusion.

In a preferred embodiment for positive dye image production with negative working silver halide emulsions the above groups D form part of the already mentioned dye releasing quinonoid IHR-compounds wherefrom a diffusible dye moiety is released by reduction and hydrolysis.

The reaction operative in the release of a dye moiety from said quinonoid IHR-compounds proceeds in two stages (A) and (B) illustrated by the following equations:

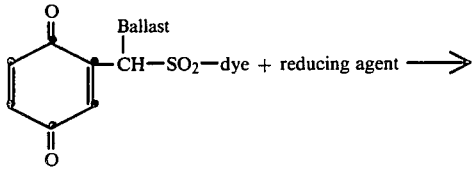

(I)

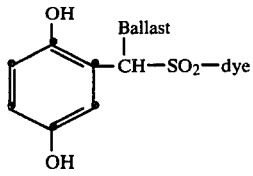

(II)

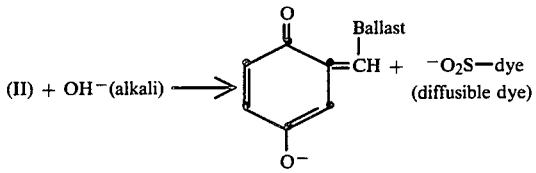

wherein:

"Ballast" stands for a ballasting group making the compound non-diffusing in a hydrophilic colloid medium under wet alkaline conditions.

The terminology "diffusing" in this invention denotes materials having the property of diffusing effectively through the colloid layers of the photographic elements in alkaline liquid medium. "Mobile" has the same meaning. The term "non-diffusing" has the converse meaning.

Particularly suited carrier groups (CAR) correspond to the following structural formulae listed in Table 1.

TABLE 1

| | |
|---|---|
| CAR 1 | 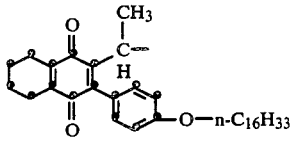 |
| CAR 2 | 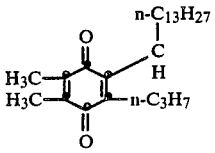 |
| CAR 3 | 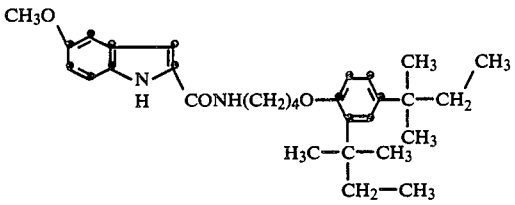 |

Examples of these groups are described in published EP-A Nos. 0 004 399, 0 038 092, published German Patent Application (DE-OS) No. 2 645 656, U.S. Pat. No. 4,273,855 and in published European Patent Application No. 0 109 701.

Particularly suited dye parts D correspond to the following structural formulae listed in Table 2.

TABLE 2

| No. | Structural formula of D | Type of compound |
|---|---|---|
| C1 | 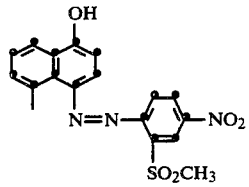 | cyan dye residue |
| Y1 | 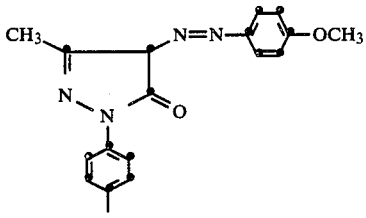 | yellow dye residue |
| Y2 | 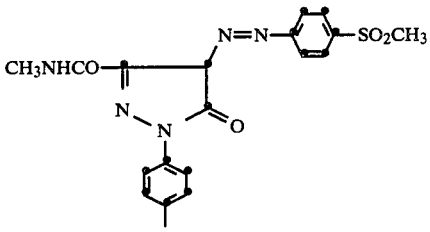 | yellow dye residue |
| M1 | 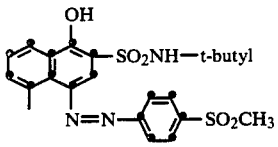 | magenta dye residue |
| C2 | 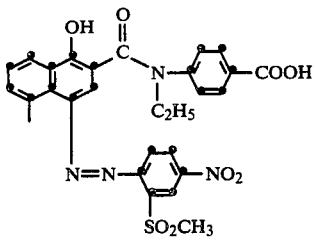 | cyan dye residue |
| C3 | 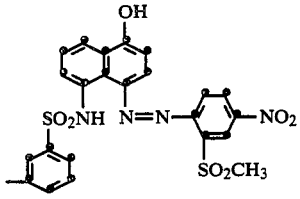 | cyan dye residue |

TABLE 2-continued

| No. | Structural formula of D | Type of compound |
|---|---|---|
| M2 | 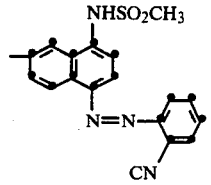 | magenta dye residue |

For the synthesis of compounds containing such group D reference is made to e.g. U.S. Pat. Nos. 3,929,760, 3,954,476, 4,225,708, 4,256,831, and EP No. 4399.

Examples of mono-azo dye compounds for use according to the present invention and being within the scope of general formula (II) are listed in the following Table 3.

The introduction of a dialkylamino group or morpholinyl group into the aromatic nuclei substituted respectively with $R_i$, $R_j$ and $R_k$ may proceed analogously to the reaction scheme followed for dimethylamino substitution.

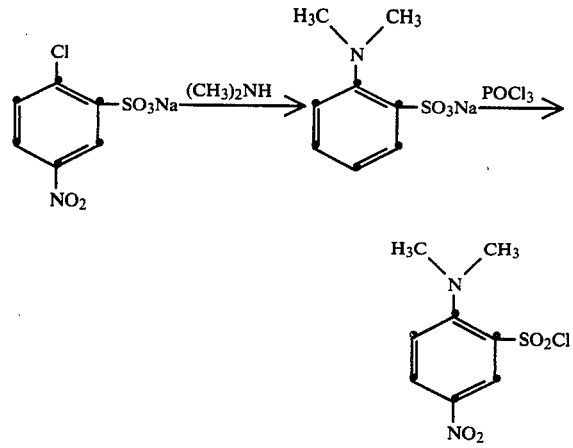

(II)

TABLE 3

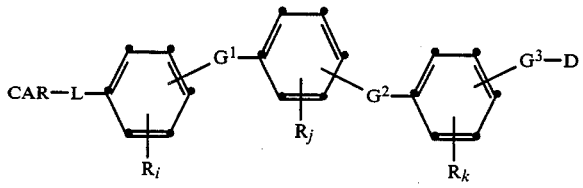

| Compound | CAR | D | L | $R_i$ | $G^1$ | $R_j$ | $G^2$ | $R_k$ | $G^3$ |
|---|---|---|---|---|---|---|---|---|---|
| 1 | CAR 1 | C1 | $SO_2$ | H | 3-$SO_2NH$— | 4'-$OCH_3$ | 3'-$SO_2NH$— | 4''-$OCH_3$ | 3''-$SO_2NH$— |
| 2 | CAR 1 | C1 | $SO_2$ | H | 4-$SO_2NH$— | 4'-$OCH_3$ | 3'$SO_2NH$— | 4''-$OCH_3$ | 3''-$SO_2NH$— |
| 3 | CAR 1 | C1 | $SO_2$ | 6-$OCH_3$ | 3-$NHSO_2$— | 6'-$OCH_3$ | 3'-$SO_2NH$— | H | 3''-$SO_2NH$— |
| 4 | CAR 1 | C1 | $SO_2$ | H | 3-$SO_2NH$— | H | 3'-$SO_2NH$— | H | 3''-$SO_2NH$— |
| 5 | CAR 1 | C3 | $SO_2$ | H | 3-$SO_2NH$— | H | 4'(—O—) | H | 4''-$SO_2NH$— |
| 6 | CAR 1 | C3 | $SO_2$ | H | 3-$SO_2NH$— | H | 4'(—$CH_2$—) | H | 4''-$SO_2NH$— |
| 7 | CAR 1 | C3 | $SO_2$ | H | 4-$SO_2NH$— | H | 3'(—$NHSO_2$—) | H | 3''-$SO_2NH$— |
| 8 | CAR 1 | C3 | $SO_2$ | H | 4-$SO_2NH$— | H | 4'(—$CH_2$—) | H | 4''-$NHSO_2$— |
| 9 | CAR 1 | C3 | $SO_2$ | H | 4-$SO_2NH$— | H | 4'(—O—) | H | 4''-$NHSO_2$— |
| 10 | CAR 1 | C3 | $SO_2$ | H | 4-$SO_2NH$— | H | 4'(—$(CH_2)_2$—) | H | 4''-$NHSO_2$— |
| 11 | CAR 1 | C3 | $SO_2$ | H | 4-$SO_2NH$— | H | 3'(—$SO_2$—) | H | 3''-$NHSO_2$— |
| 12 | CAR 1 | C3 | $SO_2$ | H | 4-$SO_2NH$— | H | 4'(—S—) | H | 4''-$NHSO_2$— |
| 13 | CAR 1 | C3 | $SO_2$ | H | 4-$SO_2NH$— | H | 3'(—S—) | H | 3''-$NHSO_2$— |
| 14 | CAR 2 | C3 | $SO_2$ | H | 4-$SO_2NH$— | H | 4'(—$OCH_2CH_2O$—) | H | 4''-$NHSO_2$— |
| 15 | CAR 1 | M2 | $SO_2$ | H | 4-$NHSO_2$— | 4'-$OCH_3$ | 3'-$NHSO_2$— | H | 3''-N=N— |
| 16 | CAR 1 | M2 | $SO_2$ | H | 4-$NHSO_2$— | 6'-$OCH_3$ | 3'-$NHSO_2$— | H | 4''-$NHSO_2$— |
| 17 | CAR 1 | Y1 | $SO_2$ | H | 4-$SO_2NH$— | 4'-$OCH_3$ | 3'-$SO_2NH$— | 4''-$OCH_3$ | 3''-$SO_2NH$— |
| 18 | CAR 1 | Y2 | $SO_2$ | H | 4-$SO_2NH$— | — | 4'-$SO_2NH$— | — | 4''-$SO_2NH$— |
| 19 | CAR 1 | M1 | $SO_2$ | H | 4-$SO_2NH$— | 4'-$OCH_3$ | 3'-$SO_2NH$— | 4''-$OCH_3$ | 3''-$SO_2NH$— |
| 20 | CAR 3 | C1 | $NHSO_2$ | H | 3-$SO_2NH$— | 4'-$OCH_3$ | 3'-$SO_2NH$— | — | 4''-$SO_2NH$— |
| 21 | CAR 1 | C1 | $SO_2$ | H | 4-$SO_2NH$— | 4'-$OCH_3$ | 3'-$SO_2NH$— | 4''-$(CH_3)_2N$ | 3''-$SO_2NH$— |
| 22 | CAR 1 | C1 | $SO_2$ | H | 4-$SO_2NH$— | 4'-$(CH_3)_2N$ | 3'-$SO_2NH$— | 4''-$OCH_3$ | 3''-$SO_2NH$— |
| 23 | CAR 1 | C1 | $SO_2$ | H | 4-$SO_2NH$— | 4'-$(CH_3)_2N$ | 3'-$SO_2NH$— | 4''-$(CH_3)_2N$ | 3''-$SO_2NH$— |

The compound 24 has the same structure as compound 22 with the difference however, that the group $R_j$ is a 4'-N-morpholinyl group.

The compound 25 has the same structure as compound 21 with the difference however that the group $R_k$ is a 4'-N-morpholinyl group. The compound 26 has the same structure as compound 23 with the difference however, that $R_j$ and $R_k$ represent respectively a 4'-N-morpholinyl and a 4''-N-morpholinyl group.

The following preparations illustrate the synthesis of IHR-compounds according to the present invention. Other compounds can be prepared analogously using the proper CARRIER part and dye part intermediates.

The preparation of compound 2 of Table 3 is illustrated by the reaction scheme followed in preparation A.

| Nr. of step | |
|---|---|
| 1 | 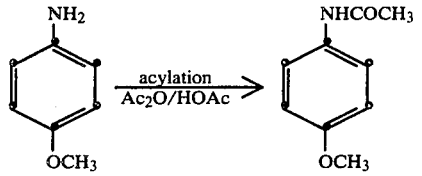  (I) (II) |
| 2 | 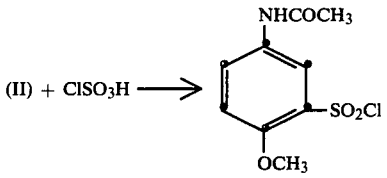  (III) |
| 3 | 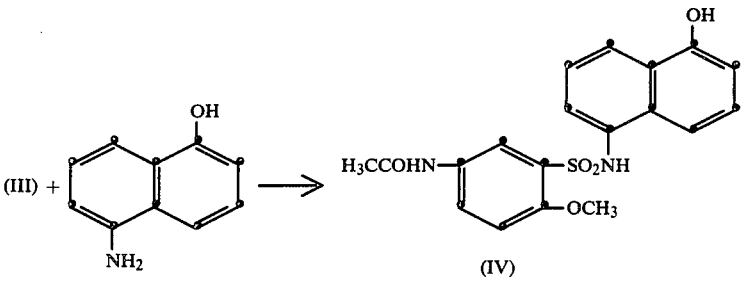  (IV) |
| 4 | 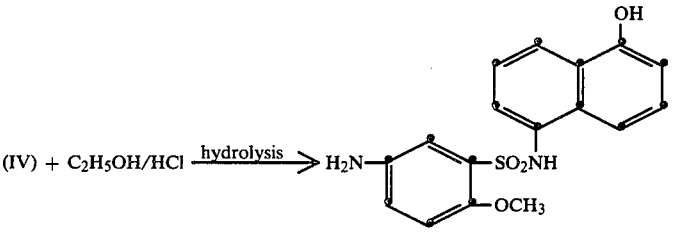  (V) |
| 5 | 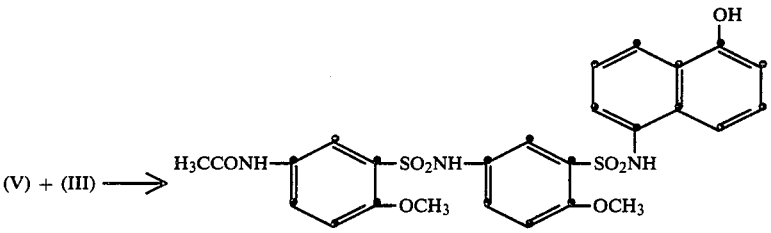  (VI) |
| 6 | 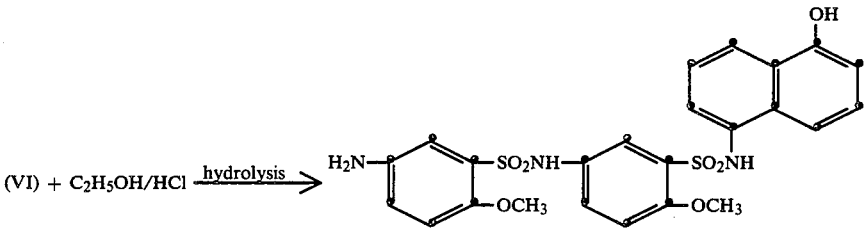  (VII) |

-continued

Nr. of step

7

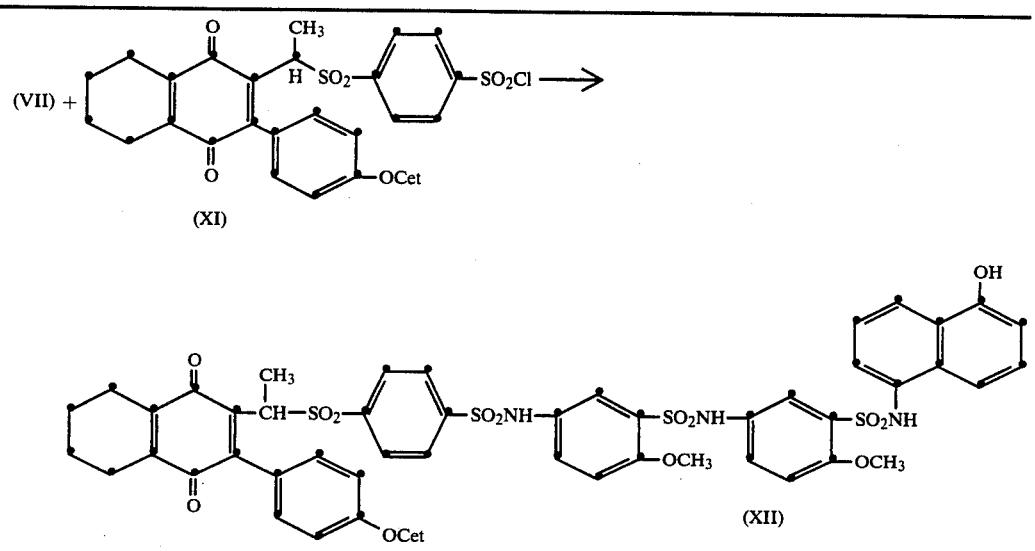

8

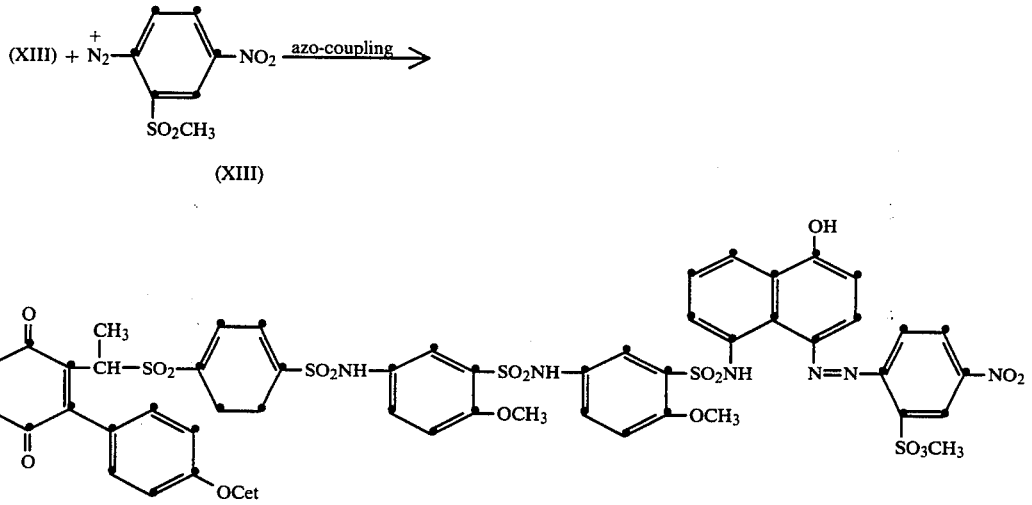

$Ac_2O$ = acetic anhydride
HOAc = acetic acid
Cet = n-$C_{16}H_{33}$

Preparation A

Step 1

1.8 kg of p-anisidine (I) were stirred in 1.8 l of acetic acid. During stirring 1.8 l of acetic anhydride were added dropwise to the suspension, keeping the temperature below 50° C. After the addition the temperature was kept at 50° C. and stirring continued till the obtaining of a clear solution. The completion of the reaction was checked by thin layer chromatography (TLC) using as eluent a mixture of methylene chloride and ethyl acetate (95/5 by volume).

The reaction mixture was finally poured into crushed ice (9 kg). The product separated initially as an oil solidifying overnight. Compound (II) was collected by suction-filtering, washed with water and dried. Yield: 2125 g. Melting point: 129° C.

Step 2

To 500 ml of chlorosulphonic acid (about 7.5 mol) were added portionwise 247.5 g (1.5 mol) of compound (II). The reaction mixture was cooled externally with ice-water thereby keeping the reaction temperature between 45° and 50° C. The addition of compound (II) took about 30 min whereupon the completion of the reaction was checked by TLC using a mixture of methylene chloride and ethyl acetate (90/10 by volume) as eluent.

The reaction mixture was poured into crushed ice (4 kg) and the obtained precipitate was collected by suction filtering. At 20° C. the precipitate was put into 10 l of methylene chloride and any water was removed by decanting. After drying in the presence of anhydrous sodium sulphate the product was concentrated by removing the solvent under diminished pressure. Yield: 250 g.

Step 3

While stirring 167.5 g (1 mol) of aminonaphthol (95%) were dissolved at 20° C. in a mixture of 1 l of acetone and 100 ml of water. For purification purposes 15 g of decolourizing carbon and 15 g of filter-aid (filter paper-pulp) were added to the solution which was filtered and the filtrate used as such after washing twice the filter cake with 100 ml of acetone.

While stirring 150 ml of pyridine were added to the filtrate. While stirring and cooling with ice-water 290 g (1.1 mol) of m-acetylamino-p-methoxy-benzenesulphonyl chloride were added portion-wise over a period of about 15 to 30 minutes keeping the temperature of the reaction mixture within the range of 15° to 20° C.

Stirring was continued for 30 minutes and the completion of the reaction was checked by TLC. (Optionally a further amount of sulphonyl chloride is added).

The reaction mixture was poured into 2 l of water and stirred till solidifying. The precipitate was separated by suction filtering, twice stirred in 1 l of water in order to remove any pyridine and separated by suction filtering again. After drying at 50° C. 350 g of compound (IV) were obtained. Melting point about 250° C.

Step 4

During stirring 386 g (1 mol) of compound (IV) were introduced into 1.75 l of ethanol. Thereupon 500 ml of concentrated hydrochloric acid (about 5 mol) were added and the mixture was heated to obtain reflux. The completion of the hydrolysis was checked by TLC and lasted about 4 to 6 h. The reaction mixture was poured into 6 l of ice-water wherein 884 g (6.5 mol) of sodium acetate-trihydrate had been dissolved. During stirring the product became solid and was separated by suction filtering. Yield: 340 g of compound (V).

Step 5

During stirring 344 g (1 mol) of compound (V) were introduced into 1.2 l of acetone. Thereupon 100 ml of water and 150 ml (about 1.875 mol) of pyridine were added. At 20° C. 290 g (1.1 mol) of the sulphonyl chloride compound (III) were added portionwise to the formed suspension. After stirring for 30 minutes at room temperature the completion of the reaction was checked by TLC. (Optionally a further amount of sulphonyl chloride is added).

The reaction mixture was poured into 3.25 l of water. The precipitate was separated by suction filtering, and washed twice by stirring in 3 l of water.

For further purification the precipitate was dissolved in 1.25 l of acetone. After dissolution 17.5 g of decolourizing carbon were added and after stirring the mixture was filtered by suction over filter-paper pulp (15 g). The filtrate and the wash-liquid (twice 100 ml of acetone) were combined and poured into 5 l of water and stirred till the precipitate became solid. After separation by suction-filtering and drying 532 g of compound (VI) (melting point about 190°) were obtained.

Step 6

During stirring 571 g (1 mol) of compound (VI) were introduced into 1.75 l of ethanol. Thereupon 600 ml of concentrated hydrochloric acid (about 6 mol) were added and the mixture heated up to reflux. While stirring reflux was continued (about 6 h) until completion of the hydrolysis reaction which was checked by TLC using a mixture of methylene chloride and methanol (90/10 by volume) as eluent.

The reaction mixture was poured into 6 l of water wherein 1020 g (7.5 mol) of sodium acetate trihydrate had been dissolved. A precipitate easily separatable by suction filtering was obtained. After separation by filtering the precipitate was washed thrice each time with 1 l of water. After a final wash by stirring in 3 l of water and suction filtering the product (VII) was dried at 50° C. Yield: 520 g. Melting range 170°-190° C.

Synthesis of compound (XI)

To 1.5 l of acetic acid were added subsequently during stirring 262 g (0.5 mol) of the carbinol compound:

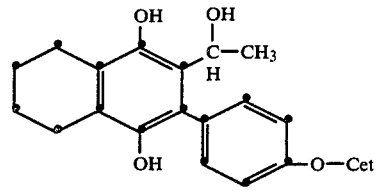

(IX)

prepared as described in published European Patent Application No. 0/109 701 and 102 g of p-aminobenzene sulphinic acid (VIII). After stirring for 30 minutes a mixture of 60 ml of concentrated sulphuric acid in 100 ml of water was added. Stirring was continued for 3 h at 50° C. Thereupon 300 g of iron(III) chloride hexahydrate (1.1 mol) dissolved in 800 ml of water as well as 800 ml of methylene chloride were added and stirring was continued for 2 h with reflux. The reaction mixture was cooled and 500 ml of water were added. The organic phase was separated and washed twice with water, dried with anhydrous sodium sulphate and concentrated by evaporating the solvent.

The residue was dissolved in 1 l of hot acetic acid. The obtained solution was cooled down to 15° C. and kept 1 h at 15° C. The precipitate formed was separated by suction filtering and washed with acetic acid. After drying 220 g of compound (X) having the following structural formula were obtained.

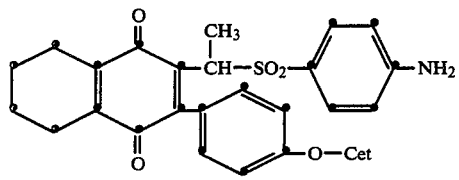

(X)

Diazotation 132.2 g (0.2 mol) of compound (X) were stirred in a mixture of 1.2 ml of acetic acid and 100 ml of concentrated hydrochloric acid. The mixture was cooled down to 10° C. and at that temperature 14.5 g of sodium nitrite dissolved in 30 ml of water were added dropwise. The diazotization reaction was allowed to continue for 30 minutes whilst stirring.

Meerwein reaction for introduction of —$SO_2Cl$.

In 1.5 ml of acetic acid 96 g (1.5 mol) of $SO_2$-gas were introduced. 13.6 g of copper(II) chloride dihydrate were added and stirring was continued till complete dissolution. thereupon 300 ml of toluene were added and the temperature of the reaction mixture was raised to 30° C.

The above prepared diazonium salt solution was added at 30° C. to said acetic acid solution and the reaction mixture was heated to 50° C. and kept whilst stirring at that temperature for 30 min.

1.5 l of a 10% by weight solution of sodium chloride were added. The organic phase was separated and the aqueous phase was washed twice with 500 ml of toluene.

The organic phase containing the combined toluene extracts was dried with anhydrous sodium sulphate. Thereupon the toluene was evaporated and the residue was stirred in 1.4 l of benzine. The precipitate was separated by suction-filtering, washed again with benzine and dried. Yield: 111 g of compound (XI). Melting point: 115° C.

Step 7

A mixture of 26.45 g (0.05 mol) of compound (VII), 44.6 g (0.06 mol) of compound (XI), 35 g of sodium-hydrogen carbonate in 600 ml of anhydrous aceton were stirred for 3 h during boiling with reflux. The completion of the reaction was checked by TLC using the following eluents: methylene chloride and methanol (90/10 by volume) and methylene chloride and ethyl acetate (98/2 by volume). The reaction mixture was filtered and from the filtrate crude compound (XII) was precipitated by adding 3 l of water.

After separation by suction-filtering and drying 62 g of crude compound (XII) was obtained. The product was purified by preparative column-chromatography using silicagel as stationary phase (adsorbent) and a mixture of methylene chloride and ethyl acetate (85/15 by volume) as eluent. Yield: 27 g.

Step 8

Diazotation 5.6 g (0.026 mol) of 4-nitro-2-methylsulphonyl-aniline were stirred in 36 ml of acetic acid and at 20° C. to the obtained solution 4 ml of concentrated sulphuric acid were added dropwise. At 15° C. by further cooling 4.3 ml of a 40% by weight solution of nitrosyl sulphuric acid in concentrated sulphuric acid were added dropwise. The reaction mixture was stirred for 15 minutes at 15° C. and the obtained diazonium salt solution was used as such.

Azo-coupling 26.5 g (0.0214 mol) of compound (XII) were dissolved in a mixture of 130 ml of methanol and 130 ml of ethyl acetate and cooled down to 5° C.

The above prepared diazonium salt solution was added at 5° to 8° C. and the reaction mixture was further stirred for 4 h at 5°-10° C. The reaction mixture was kept overnight, whereupon the formed precipitate was separated by suction filtering and washed twice with methanol. After drying 22.5 g of crude compound (XIV) were obtained.

Purification proceeded by preparative column chromatography using silicagel as adsorbent and a mixture of methylene chloride and ethyl acetate (80/20 by volume) as eluent. Yield: 4.8 g of orange-yellow product.

Other compounds according to the present invention having other carrier moieties and/or dye part units can be prepared analogously or by techniques known in the art starting with the appropriate chemicals.

The compounds according to the present invention are applied in a dye diffusion transfer process and for that purpose are used in operative association with a light-sensitive silver halide emulsion layer, preferably of the negative-working type, i.e. of the type obtaining a silver image in the photo-exposed areas.

For monochrome dye image production a photographic silver halide emulsion material according to the present invention comprises a support carrying at least one alkali-permeable silver halide hydrophilic colloid emulsion layer having in operative association therewith one of said compounds.

By "operative association" is understood that the release of a diffusible dye moiety, e.g. azo dye, from the compound can proceed in accordance with the development of the silver halide emulsion layer. Therefore, the dye-releasing compound has not necessarily to be present in the silver halide emulsion layer but may be contained in another layer being in water-permeable relationship therewith.

In an embodiment for producing multicolour images this invention relates to photographic materials that comprise a support carrying (1) a red-sensitive silver halide emulsion layer having operatively associated therewith a said dye-releasing compound that is initially immobile in an alkali-permeable colloid medium and wherefrom through the reducing action of a silver halide developing agent and alkalinity a cyan dye is split off in diffusible state, (2) a green-sensitive silver halide emulsion layer having operatively associated therewith a said compound of (1) with the difference that a magenta dye is split off in diffusible state, and (3) a blue-sensitive silver halide emulsion layer having operatively associated therewith a said compound of (1) with the difference that a yellow dye is split off in diffusible state. In the present colour-providing compounds the dye group(s) may be associated with substituents that form a shifted dye.

Shifted dyes as mentioned, e.g., in U.S. Pat. No. 3,260,597 include those compounds wherein the light-absorption characteristics are shifted hypsochromically or bathochromically when subjected to a different environment such as a change of the $pK_a$ of the compound, or removal of a group such as a hydrolyzable acyl group linked to an atom of the chromophoric system and affecting the chromophore resonance structure. The shifted dyes can be incorporated directly in a silver halide emulsion layer or even on the exposure side thereof without substantial absorption of light used in recording. After exposure, the dye is shifted to the appropriate colour, e.g. by hydrolytic removal of said acyl group.

It is preferred to carry out the colour diffusion transfer process with the present coloured IHR-quinonoid compounds in conjunction with a mixture of reducing agents at least two of which being a compound called electron donor (ED-compound) and a compound called electron-transfer agent (ETA-compound) respectively.

The ED-compounds are preferably non-diffusing, e.g. are provided with a ballasting group, so that they remain within the layer unit wherein they have to transfer their electrons to the quinonoid compound.

The ED-compound is preferably present in non-diffusible state in each silver halide emulsion layer containing a different non-diffusible coloured IHR-quinonoid compound. Examples of such ED-compounds are ascorbyl palmitate and 2,5-bis(1',1',3',3'-tetramethylbutyl)hydroquinone. Other ED-compounds are disclosed in U.S. Pat. No. 4,139,379 and in published DE-A No. 2,947,425. Instead of an ED-compound an electron-donor precursor (EDP) compound can be used in the photographic material as described e.g. in published DE-A No. 2,809,716 and in U.S. Pat. No. 4,278,750. Particularly useful ED-precursor compounds for combination with the present IHR compounds are disclosed in published EP-A No. 0 124 915 and in published DE-A No. 3,006,268, which in the latter case correspond to the following general formula:

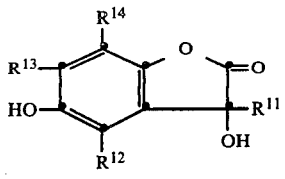

wherein:

$R^{11}$ represents a carbocyclic or heterocyclic aromatic ring, each of $R^{12}$, $R^{13}$ and $R^{14}$ (same or different) represents hydrogen, alkyl, alkenyl, aryl, alkoxy, alkylthio, amino, or $R^{13}$ and $R^{14}$ together represent an adjacent ring, e.g. carbocyclic ring, at least one of $R^{11}$, $R^{12}$, $R^{13}$ and $R^{14}$ representing a ballast group having from 10 to 22 carbon atoms.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

Typically useful ETA-compounds include hydroquinone compounds, aminophenol compounds, catechol compounds, phenylenediamines and 3-pyrazolidinone compounds e.g. 1-aryl-3-pyrazolidinone as defined, e.g., in U.S. Pat. No. 4,139,379.

A combination of different ETA's such as those disclosed in U.S. Pat. No. 3,039,869 can be employed likewise. Such developing agents can be used in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and quinonoid compound used in the process and the processing conditions for the particular photographic element.

The concentration of ED-compound or ED-precursor compound in the photographic material may vary within a broad range but is, e.g., in the molar range of 1:1 to 8:1 with respect to the quinonoid compound. The ETA-compound may be present in the alkaline aqueous liquid used in the development step, but is used preferably in diffusible form in a non-sensitive hydrophilic colloid layer adjacent to at least one silver halide emulsion layer.

Migration of non-oxidized developing agent, e.g. acting as ETA-compound, proceeds non-image-wise and has an adverse effect on correct colour rendering when surplus developing agent remains unoxidized in the photoexposed areas of a negative-working emulsion layer. Therefore, according to a preferred embodiment of the present invention a silver halide solvent, e.g. thiosulphate, is used to mobilize unexposed silver halide in complexed form for helping to neutralize (i.e. oxidize by physical development) migrated developing agent in the photoexposed areas wherein unaffected developing agent (ETA-compound) should no longer be available for reacting with the quinonoid compound directly or through the applied ED-compound. The use of silver halide solvents for that purpose has been described in the published EP-A No. 0049002.

In order to obtain a better colour rendition it is also advantageous to intercept oxidized ETA-compound and to prevent it from migrating to adjacent imaging layers where it could cause the undesired oxidation of ED-compound. For said interception so-called scavengers are used that are incorporated in the photographic material in non-diffusible state, e.g. in interlayers between the imaging layers. Suitable scavengers for that purpose are described, e.g., in U.S. Pat. No. 4,205,987 and published EP-A No. 0,029,546.

The present dye releasing compounds and optionally ED or EDP-compounds can be incorporated in the photographic material by addition to the coating liquid(s) of its layer(s) by the usual methods known, e.g., for the incorporation of colour couplers in photographic silver halide emulsion materials.

The amount of dye-releasing compound coated per sq.m may vary within wide limits and depends on the maximum colour density desired.

The photographic material may contain (a) filter layer(s) to improve the correct spectral exposure of the differently spectrally sensitive silver halide emulsion layers, e.g. a yellow (colloidal silver) layer below the only blue-sensitive silver halide emulsion layer and a magenta filter layer below the green-sensitive silver halide emulsion layer absorbing green light whereto the underlying red-sensitized silver halide emulsion layer may be sensitive to some extent. A suitable magenta dye for that purpose is Violet Quindo RV 6911—Colour index, C.I. 46500 Pigment Violet 19.

The support for the photographic elements of this invention may be any material as long as it does not deleteriously affect the photographic properties of the film unit and is dimensionally stable. Typical flexible sheet materials are paper supports, e.g. coated at one or both sides with an α-olefin polymer, e.g. polyethylene; they include cellulose nitrate film, cellulose acetate film, poly(vinyl acetal) film, polystyrene film, poly(ethylene terephthalate) film, polycarbonate film, poly-α-olefins such as polyethylene and polypropylene film, and related films or resinous materials. The support is usually about 0.05 to 0.15 mm thick.

The image-receiving layer can form part of a separate image-receiving material or form an integral combination with the light-sensitive layer(s) of the photographic material.

Where the image-receiving layer after processing of the photosensitive material remains associated with the silver halide emulsion layer(s) normally an alkali-permeable light-shielding layer, e.g. containing white pigment particles is applied between the image-receiving layer and the silver halide emulsion layer(s).

For use in dye diffusion transfer photography any material may be employed as the image-receiving layer as long as the desired function of mordanting or otherwise fixing the diffused dye will be obtained. The particular material chosen will, of course, depend upon the dye to be mordanted. If acid dyes are to be mordanted, the image-receiving layer may be composed of or contains basic polymeric mordants such as polymers of amino-guanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the metho-p-toluene sulphonate of 2-vinylpyridine and similar compounds described in U.S. Pat. No. 2,484,430 of Robert H. Sprague and Leslie G. Brooker, issued Oct. 11, 1949, and the compounds described in the published DE-A No. 2,200,063 filed Jan. 11, 1971 by Agfa-Gevaert A. G. Suitable mordanting binders include, e.g., guanylhydrazone derivatives of acyl styrene polymers, as described, e.g., in published DE-A No. 2,009,498 filed Feb. 28, 1970 by Agfa-Gevaert A. G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. Nos. 3,271,147 of Walter M. Bush and 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solution, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkyl-phenols, etc.

Use of pH-lowering material in the dye-image-receiving element will usually increase the stability of the transferred image. Generally, the pH-lowering material will effect a reduction of the pH of the image layer from about 13 or 14 to at least 11 and preferably 5 to 7 within a short time after imbibition. E.g., polymeric acids as disclosed in U.S. Pat. No. 3,362,819 of Edwin H. Land, issued Jan. 9, 1968, or solid acids or metal salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed over the pH-lowering layer, which "times" or controls the pH reduction depending on the rate at which alkali diffuses through the inert spacer layer. Examples of such timing layers include gelatin, polyvinyl alcohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures. e.g, premature pH reduction is prevented when imbibition is effected at temperatures above room temperature, e.g. at 35° to 37° C. The timing layer is usually about 2.5 μm to about 18 μm thick. Especially good results are obtained if the timing layer comprises a hydrolysable polymer or a mixture of such polymers that are slowly hydrolysed by the processing composition. Examples of such hydrolysable polymers include polyvinyl acetate, polyamides, cellulose esters, etc.

An alkaline processing composition employed in the production of dye images according to the present invention may be a conventional aqueous solution of an alkaline material, e.g. sodium hydroxide, sodium carbonate or an amine such as diethylamine, preferably possessing a pH beyond 11.

According to one embodiment the alkaline processing liquid contains the diffusible developing agent that effects the reduction of the silver halide, e.g. ascorbic acid or a 3-pyrazolidinone developing agent such as 1-phenyl-4-methyl-3-pyrazolidinone.

The alkaline processing composition employed in this invention may also contain a desensitizing agent such as methylene blue, nitro-substituted heterocyclic compounds, 4,4'-bipyridinium salts, etc., to insure that the photosensitive element is not further exposed after its removal from the camera for processing.

For in-camera-processing, the solution also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of about 1 to about 5% by weight of the processing composition is preferred. It imparts thereto a viscosity of about 100 mPa.s to about 200,000 mPa.s.

Although the common purpose in the known dye-diffusion transfer systems is the production of dye images in a receiving layer or sheet whereby the released dye(s) are eliminated from the photosensitive element by diffusion transfer, a residual image of dye may be likewise of practical interest forming a so-called "retained image". The latter terminology is used, e.g., in Research Disclosure (No. 17362) of September 1978 and a dye-diffusion process relating thereto is exemplified in Research Disclosure (No. 22711) of March 1983.

Processing may proceed in a tray developing unit as is contained, e.g., in an ordinary silver complex diffusion transfer (DTR) apparatus in which contacting with a separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp/Leverkusen.

According to an embodiment wherein the image-receiving layer is integral with the photosensitive layer(s), the processing liquid is applied from a rupturable container or by spraying.

A rupturable container that may be employed is e.g. of the type disclosed in U.S. Pat. Nos. 2,543,181 of Edwin H. Land, issued Feb. 27, 1951, 2,643,886 of Ulrich L. di Ghilini, issued June 30, 1953, 2,653,732 of Edwin H. Land, issued Sept. 29, 1953, 2,723,051 of William J. McCune Jr., issued Nov. 8, 1955, 3,056,492 and 3,056,491, both of John E. Campbell, issued Oct. 2, 1962, and 3,152,515 of Edwin H. Land, issued Oct. 13, 1964. In general, such containers comprise a rectangular sheet of fluid- and air-impervious material folded longitudinally upon itself to form two walls that are sealed to one another along their longitudinal and end margins to form a cavity in which processing solution is contained.

The following further illustrate the present invention. All percentages and ratios are by weight, unless otherwise mentioned, and the amounts are expressed per sq.m.

Preparation of photographic material

A subbed polyethylene terephthalate support having a thickness of 0.1 mm was coated in the mentioned order with the following layers:

| | | |
|---|---|---|
| (1) | a silver halide emulsion layer containing: | |
| | gelatin | 1.8 g |
| | AgCl expressed as $AgNO_3$ | 0.5 g |
| | cyan dye-providing compound 2 of table 3 | 0.333 g |
| | ED compound: 2,5-bis(1',1',3',3'-tetra-methybutyl)-hydroquinone | 0.09 g |
| (2) | protective layer containing: | |
| | gelatin | 6 g |
| | 1-phenyl-4-methyl-pyrazolidin-3-one | 0.12 g |
| | citric acid up to a pH of 4.5 in the two layers | 0.06 g |

Other dye releasing compounds indicated by number in Table 3 were coated in the same way using the same molar amount.

The processing was carried out in a COPYPROOF (registered trade name of Agfa-Gevaert N. V. Belgium) T42 diffusion transfer processing apparatus containing in its tray an aqueous solution comprising per liter:

| | |
|---|---|
| sodium hydroxide | 25 g |
| sodium orthophosphate | 25 g |
| cyclohexane dimethanol | 80 g |
| sodium bromide | 2 g |
| sodium thiosulphate | 2 g |
| water up to | 1 liter. |

After being wetted at room temperature (20° C.) with said solution the exposed photographic materials were contacted for 1 min with the receptor material as described hereinafter to allow the diffusion transfer of the dyes. After separating the photographic materials from the receptor material dye transfer was measured with a MACBETH (trade name) densitometer RD-919 in the Status A modus.

Preparation of the dye receptor material

To a corona-treated polyethylene coated support a coating having the following composition was applied per sq.m:

| | | |
|---|---|---|
| (1) | gelatin | 2.5 g |
| | polymeric mordanting agent prepared from 4,4'-diphenylmethane diisocyanate and N-ethyldiethanolamine quaternized with epichlorohydrine according to published German Patent Application (DE-OS) 2,631,521 Example 1 | 2.5 g |
| (2) | protective gelatin layer | 0.8 g |

The stability against light was tested with a XENOTEST (trade name) type 50 apparatus of Hanau Quartzlampen GmbH, Hanau, W. Germany wherein the material was exposed with white light and ultra-violet light for 8 h. The % loss in maximum density of transferred dye is mentioned in Table 4 (second column). The third column gives the loss in maximum density when the receptor material was coated with an UV protecting layer subsequent to dye transfer but prior to the XENOTEST treatment. Structural formula of reference compound: Ref. 1.

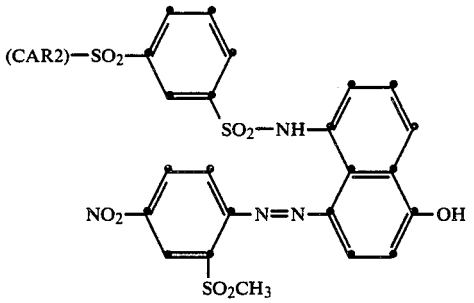

prepared by procedures analogous to those described in published European Patent Application No. 0 109 701.

TABLE 4

| Compound of table 3 | % loss in maximum density | % loss after UV coating |
|---|---|---|
| 1 | −48 | −22 |
| 2 | −42 | −22 |
| 4 | −38 | −28 |
| 5 | −42 | −28 |
| 6 | −51 | −35 |
| 7 | −44 | −28 |
| 8 | −50 | −31 |
| compound ref. 1 | −65 | −52 |

We claim:

1. A photographic silver halide emulsion material containing a ballasted non-diffusing compound capable of releasing a diffusible mono-azo dye or dye precursor thereof from a carrier moiety, characterized in that said compound corresponds to the following general formula:

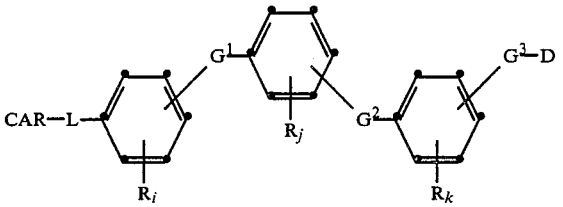

wherein:

CAR represents a ballasted carrier moiety making said compound non-diffusing in a hydrophilic colloid medium after wet alkaline conditions, L represents a chemical group cleavable or releasable from the carrier moiety as a function of a redox-reaction or argentolytic reaction taking place in the development of a silver halide emulsion layer under alkaline conditions, $G^1$ and $G^3$ (same or different) is a $—SO_2NR^3—$ or $—NR^3—SO_2—$ group wherein $R^3$ is hydrogen, an alkyl group or an aryl group, $G^2$ is a chemical bond or a bivalent linking atom or group selected from the group consisting of —O—, —S—, $—SO_2—$, $—CH_2—$, $—CH_2CH_2—$, $—NH^3—$, $—OCH_2CH_2O—$, $—OCH_2CH_2—$, $—CONR^3—$, $—SO_2NR^3—$, $—NR^3CO—$ or $—NR^3SO_2—$, wherein $R^3$ is hydrogen, an alkyl group or an aryl group, $R_i$, $R_j$ and $R_k$ (same or different) is hydrogen or one or more substituents selected from the group consisting of halogen, an alkyl group, alkoxy, alkylthio, a $R^4$ CONH— group or a $R^4SO_2NH$— group, wherein $R^4$ is an alkyl group or an aryl group, and D is an azo dye part.

2. Material according to claim 1, wherein L is —S—, —$SO_2$—, —$NHSO_2$— or —$N^+R^1R^2$—, wherein each of $R^1$ and $R^2$ (same or different) is an alkyl group or an aryl group.

3. Material according to claim 1, wherein CAR is a hydroquinone or quinone type residue.

4. Material according to claim 1, comprising a support carrying red-, green- and blue-sensitive silver halide emulsion layers each having operatively associated therewith a said dye-releasing compound that is initially immobile in an alkali-permeable colloid medium and wherefrom through the reducing action of a silver halide developing agent and alkalinity a cyan, magenta or yellow dye respectively is splittable off in diffusible state.

5. Material according to claim 4, wherein said photographic material contains in each silver halide emulsion layer a non-diffusible electron donor compound or electron donor precursor compound.

6. Material according to claim 1, wherein said photographic material contains (a) silver halide emulsion layer(s) of the negative-working type.

* * * * *